United States Patent [19]

Peterson

[11] 3,968,968

[45] July 13, 1976

[54] MINI-VOLLEYBALL COURT LAYOUT

[76] Inventor: Richard C. Peterson, 425 Apollo Drive, Joliet, Ill. 60435

[22] Filed: Apr. 28, 1975

[21] Appl. No.: 572,144

[52] U.S. Cl. ..... 273/95 H; 273/29 BB

[51] Int. Cl.[2] ..... A63B 71/02

[58] Field of Search ..... 273/29 B, 30, 95 R, 273/95 A, 95 H, 1 A, 1 R, 102 R, 29 BB

[56] References Cited

UNITED STATES PATENTS

| | | | |
|---|---|---|---|
| 1,509,490 | 9/1924 | Sawyer | 273/95 H |
| 2,207,864 | 7/1940 | Hoeltje | 273/95 H |
| 2,697,603 | 12/1954 | Haines | 273/95 A |
| 3,078,094 | 2/1963 | Goodenough | 273/30 |
| 3,536,327 | 10/1970 | Kaehne | 273/95 R |
| 3,817,520 | 6/1974 | Burgos | 273/58 D |
| 3,860,240 | 1/1975 | Koch | 273/95 R |

FOREIGN PATENTS OR APPLICATIONS

| | | | |
|---|---|---|---|
| 599,727 | 3/1948 | United Kingdom | 273/95 H |

*Primary Examiner*—Richard C. Pinkham
*Assistant Examiner*—Marvin Siskind
*Attorney, Agent, or Firm*—Marden S. Gordon

[57] ABSTRACT

A game apparatus for the playing of mini-volleyball by two players disposed in a sitting or kneeling position, the apparatus including corner weights having a flexible cord extending therebetween and defining a rectangular playing court, the court divided in half by a net extending transversely of the court and supported by weighted end posts, the net being readily attached to and detached from the end posts in a manner automatically setting the net to the desired height for play.

5 Claims, 7 Drawing Figures

MINI-VOLLEYBALL COURT LAYOUT

BACKGROUND OF THE INVENTION

1. Field of the Invention

This invention relates generally to games and more particularly to a novel and improved mini-volleyball game apparatus for play by two players each sitting or kneeling in their own portion of the playing court.

2. Description of the Prior Art

Competitive games of different types and nature, such as basketball, baseball, football, and the like have always proven quite popular among the general population, the difficulty in playing of such games being the requirement of a large amount of space required for play along with the simultaneous gathering of a large number of individuals required in the play, such as a minimum of at least eighteen players in baseball for two teams.

Recognizing the disadvantages of having to obtain such a large play area along with gather such a large number of people together, it would be desirable to provide a game which could be played by two players in a competitive manner and without requiring a large amount of space along with it being possible to play the game both on hard and soft surfaces varying between concrete such as a driveway or basement, and sand, such as found on a beach.

SUMMARY OF THE INVENTION

The present invention provides a novel game apparatus for the playing of mini-volleyball on any type of hard or soft surface and requiring a minimum of space, the game being rapidly set up for usage and return to storage after usage without requiring any special tools or expertise.

It is a feature of the present invention to provide a novel mini-volleyball game apparatus.

A further feature of the present invention provides a mini-volleyball game apparatus which is relatively simple in its construction and which, therefore, may be readily manufactured at a relatively low cost and by simple manufacturing methods so that it can be retailed at a sufficiently low price to encourage widespread use and purchase thereof.

Still a further feature of the present invention provides a mini-volleyball game apparatus which is possessed of few parts so that it is easy to use and reliable and efficient in operation requiring no special expertise or tools for the use thereof.

Other features and advantages of this invention will be apparent during the course of the following description.

BRIEF DESCRIPTION OF THE DRAWINGS

In the accompanying drawings forming a part of this specification, and in which like reference characters are employed to designate like parts throughout the same.

DESCRIPTION OF THE PREFERRED EMBODIMENT

Figures 1, 2, 3, 4, 5, 6, 7, 8:
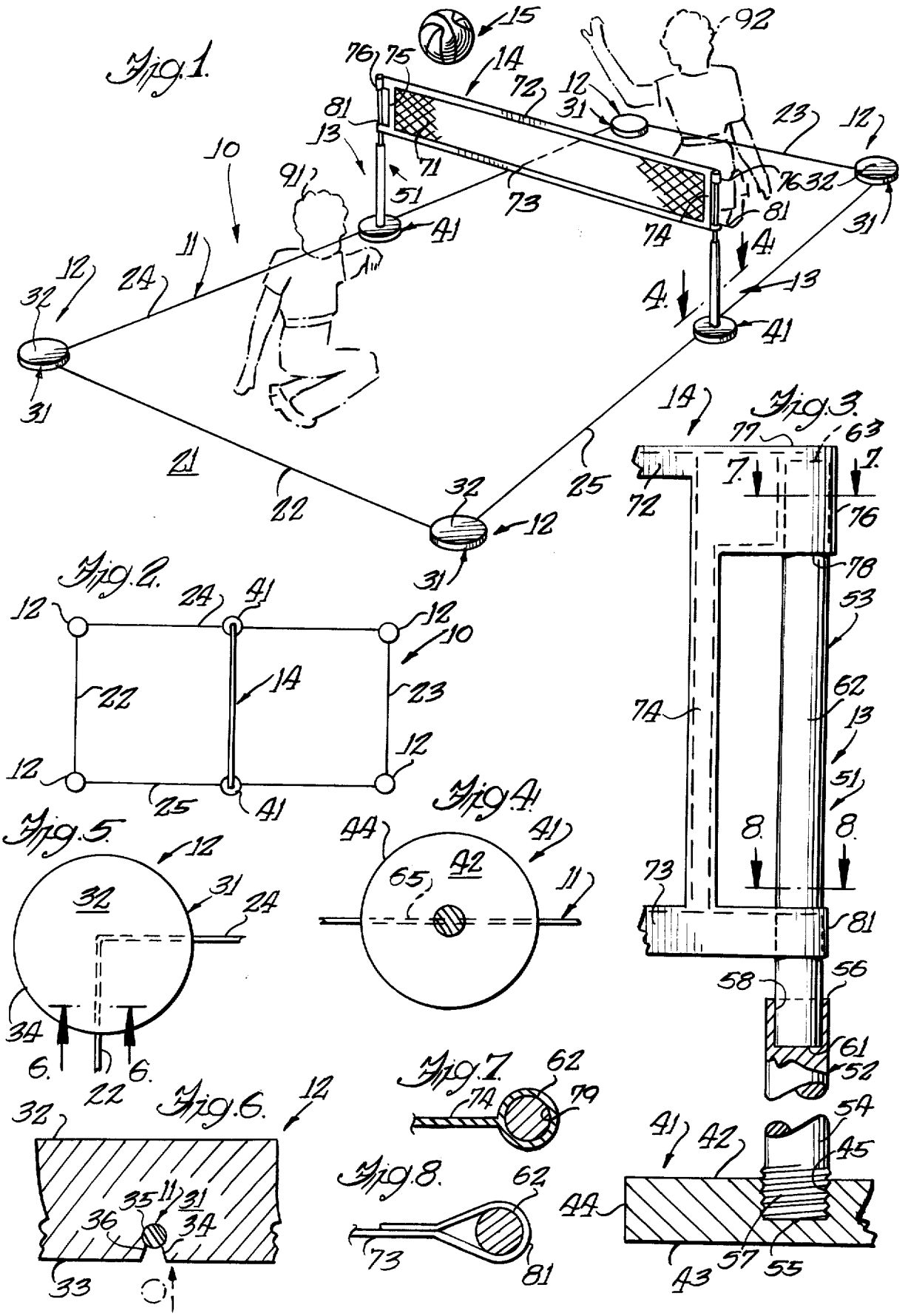
FIG. 1 is a perspective view of the mini-volleyball game apparatus of the present invention in its operative position ready for usage.
FIG. 2 is a top plan view of the apparatus of FIG. 1.
FIG. 3 is an enlarged fragmentary front elevational view of an end post and one side of the playing net affixed thereto.
FIG. 4 is an enlarged cross-sectional view taken along line 4—4 of FIG. 1.
FIG. 5 is a top plan view of one of the corner weight members of the apparatus.
FIG. 6 is an enlarged cross-sectional view taken along line 6—6 of FIG. 5.
FIG. 7 is a cross-sectional view taken along line 7—7 of FIG. 3.
FIG. 8 is a cross-sectional view taken along line 8—8 of FIG. 3.

Referring now to the drawings in detail, there is illustrated a preferred form of the mini-volleyball game apparatus constructed in accordance with the principles of the present invention and which is designated generally in its entirety by the reference numeral 10 and which is comprised of a flexible cord 11, corner weight members 12, end posts 13, a playing net 14, and a ball 15.

The cord 11 may be a flexible string, rope and the like and is preferably of a one-piece unitary length of endless cord material adapted to be laid on playing surface 21 in a rectangular closed loop shape defining a rectangular playing court having opposed parallel end lines 22 and 23, and opposed parallel spaced apart side lines 24 and 25. In the preferred embodiment, the overall court size is six feet wide by twelve feet long. The cord 11 may be of any desired color.

For holding the cord 11 in the desired rectangular configuration, such as shown in FIG. 1, there are provided four corner weight members 12, each of an identical configuration and each having a flat circular disc shaped body member 31 having a flat top surface 32, a flat bottom surface 33, cylindrical sidewalls 34, and are manufactured of a material providing weight to the members. Provided in each of the bottom surfaces 33 is an L-shaped slot 34 which bends at the central axis of the body member 31, the slot opening out of bottom surface 33 and being of a keyhole cross-sectional configuration having top cylindrical segment 35 and bottom truncated triangular segment 36, this being as clearly illustrated in FIG. 6 of the drawings. The intersection between segments 35 and 36 is slightly less than the diameter of cord 11 such that the cord is forced up through segment 36 to be received in segment 35 for detachably retaining the cord to the weighted members 12.

A pair of the end posts 13 are provided, each being of an identical configuration with each having a flat circular disc-shaped base 41, having flat top surface 42, flat bottom surface 43, cylindrical sidewalls 44, and a threaded aperture 45 disposed centrally of top surface 42 and extending vertically thereinto. The base 41 is manufactured of a weighted material, such as wood, and is about seven inches in diameter and has a thickness of about one and one-quarter inch.

Associated with each base 41 is a pole member 51 having a bottom pole section 52 and a top pole section 53. The bottom pole section 52 is of an elongated cylindrical configuration having cylindrical body member 54 with a bottom end 55 and a top end 56. Screw threads 57 are provided about the circumference of body member 54 adjacent bottom end 55 for removably screwing such bottom end into threaded aperture 45 of base 41 such that the bottom segment 52 extends vertically upwardly from the base member. A cylindrical socket 58 is disposed concentric of top end 56 and extends into the body member 54 and is of a diameter to snugly receive therein the bottom end portion 61 of the cylindrical body member 62 making up top post section 51 and having a top end 63. Each of the top and bottom post sections 52 and 53 are about eighteen inches in length such that from top end 63 to base bottom surface 43 there is a distance of about thirty-six inches.

The ball 15 is about four inches in diameter, is of a spherical configuration, is preferably manufactured of sponge rubber, and has a coefficient of restitution which is less than the coefficient of restitution of a normal standard conventional volleyball.

For securing the end post base members 41 to cord 11 there extends through the bottom surface 43 thereof a slot 65 which is of the same key-hole cross-sectional configuration as slot 34, the slot 65 extending diametrically through base member 41 and adapted to have the cord 11 forced thereinto after the base member is positioned at the desired location along the court.

The net 14 is of elongated flat rectangular configuration having a length of about six feet and a width of about eight inches, and includes mesh body member 71 surrounded on its top, bottom and side edges by binding strips 72-75. Adjacent the top of each binding strip 74 and 75 extending outwardly therefrom is a cloth formed cap member 76 closed at top end 77 and open at bottom end 78 to provide access into cylindrical socket 79 which is of a diameter to receive therein the top end portion 63 of top post section 53.

Affixed to the bottom end portions of each of the end binding strips 74 and 75 and extending outwardly therefrom a distance the same as cap 76 is a cloth formed loop member 81 adapted to slide over body member 62 when net 14 is placed onto end post 13.

It is to be understood that by means of loops 81 and caps 76 that the net 14 is rapidly attached to and detached from the end post 13 without requiring any tie-down or the like with the cap 76 automatically positioning the net on the end posts at the desired height from the playing surface 21 and retaining the net straight and taut across the top binding 72 with the loops 81 allowing the net to hang properly. Thus, no tying, fastening, or other means are required to hold the net to the end posts other than the caps 76 and loops 81.

In setting up the apparatus, cord 11 is placed into the desired rectangular configuration, corner members 12 are affixed to the corners of the court, base members 41 are affixed to the side lines 24 and 25 intermediate end lines 22 and 23, poles 13 are affixed to the base members 41, and the net 14 is mounted onto the poles. The players 91 and 92 then take a sitting or kneeling position in their respective portions of the playing court with one of the players holding ball 15. That player initiates play of the game by serving the ball 15 over net 14 to the opposing player situated on the opposite side of the net and defending the court area defined between the net in front of the player, the end line behind the player, and the sidelines on each side of the player. The opposing player volleys the ball back over the net without letting the ball hit or land in the court area being protected, and is careful to hit the ball back so it will be within the court area to be protected by the opposite player. This volleying continues until a point is scored by one of the players by the opposite player either failing to volley the ball back before the ball hit into the protected court area, or by the opposite player striking the ball out of the playing court area.

It is to be understood that the form of this invention herewith shown and described is to be taken as a preferred example of the same, and that this invention is not to be limited to the exact arrangement of parts shown in the accompanying drawings or described in this specification as various changes in the details of construction as to shape, size, and arrangement of parts may be resorted to without departing from the spirit of the invention, the scope of the novel concepts thereof, or the scope of the sub-joined claims.

Having thus described the invention, what is claimed is:

1. A mini-volleyball game apparatus comprising, in combination:

a playing court defining means consisting of a one-piece unitary length of endless flexible cord to be restingly positioned on the ground and oriented into a rectangular closed loop shape defining a rectangular playing court having opposed parallel spaced apart end lines and opposed parallel spaced apart side lines;

a set of four identically configured weight members for retaining the corners of the cord of the playing court defining means, each weight member having a flat circular disc-shaped body member, a flat top surface, a flat bottom surface, and cylindrical side wall surfaces;

an L-shaped slot disposed in the bottom surface of each of said weight members, said slot opening out of the bottom surface to releaseably engage a portion of said cord therein, said slot being of a key-hole cross-sectional configuration having a generally cylindrical top section joined tangentially to the top portion of a truncated triangular section, the distance between the point of intersection between the triangular section and the cylindrical top section being less than the diameter of the cord whereby said cord is forced through the triangular section to be releaseably frictionally engaged in the cylindrical section;

net means adapted to divide the playing court area in half;

post means adapted to hold the net means in the desired location;

a spherical playing ball; and means associated with said net holding means and adapted to engage said court defining means for assisting and holding said court defining means in said predetermined configuration.

2. The apparatus as set forth in claim 1 wherein said net supporting post means are each of an identical configuration and each comprises, in combination:

a flat circular disc-shaped base member having a flat top surface, a flat bottom surface, and cylindrical side walls;

a threaded aperture formed centrally of the top surface and opening out of said top surface;

a slot extending diametrically through the bottom surface to engage a portion of the cord therein for securing the base member to the cord with the socket being bisected by a vertical plane passing through the slot;

a bottom pole section of an elongated cylindrical configuration having a top end and a bottom end, screw threads disposed about the bottom end to be threadedly received in said threaded aperture, a cylindrical socket disposed concentric with said top end and opening inwardly of the bottom pole member;

an elongated cylindrically shaped top pole member having a top end and a bottom end and being of a diameter to have its bottom end snugly received in the bottom pole top end socket such that the top pole is disposed in axial alignment with the bottom pole and supported thereon.

3. The apparatus as set forth in claim 2 wherein the net means comprises, in combination:

an elongated, rectangularly shaped, flat, flexible mesh material of a length to extend substantially completely transversely between the side lines of the playing court, said mesh net having flat top edge, a flat bottom edge, and opposed end edges;

a pair of cap members, each cap member associated with an end edge of said mesh material adjacent the top edge thereof and extending transversely outwardly therefrom, each cap member being identical and having a closed top end, an open bottom end, and a cylindrical socket disposed inwardly thereof and opening out of said open bottom end and of a diameter to removably receive said top end of said top pole section therein; and a pair of loop members each associated with an end edge of said mesh material and extending transversely outwardly of the bottom edge thereof a distance substantially equal to the outward extension of said cap members and in general alignment with said cap members and forming a closed loop of a size and configuration adapted to receive said top pole section freely therethrough.

4. The apparatus as set forth in claim 3 further characterized by said spherical playing ball having a coefficient of restitution less than the coefficient of restitution of a normal standard sized conventional volleyball.

5. The apparatus as set forth in claim 4 further characterized by the slot extending diametrically through the bottom surface of the supporting post being of a key-hole type cross-sectional configuration of a size and configuration identical to the size and configuration of the cross-section of the key-hole slot in the end corner members.

* * * * *